US005873211A

United States Patent [19]

Post et al.

[11] Patent Number: 5,873,211

[45] Date of Patent: Feb. 23, 1999

[54] BRACKET FOR SPEED LEAD

[76] Inventors: Marvin W. Post, deceased, late of Eagan, Minn.; by Marvin Post, Jr., executor, 19515 Jasper Ter., Lakeville, Minn. 55044

[21] Appl. No.: 889,721

[22] Filed: Jul. 8, 1997

[51] Int. Cl.[6] ..... F04G 21/22; B43L 13/00

[52] U.S. Cl. ..... 52/749.13; 52/747.12; 52/DIG. 1; 33/404; 33/410; 33/408

[58] Field of Search ..... 52/747.12, 747.13, 52/749.13, 749.1, DIG. 1; 33/404, 407, 408, 410

[56] References Cited

U.S. PATENT DOCUMENTS

| | | | |
|---|---|---|---|
| 2,761,214 | 9/1956 | Ruble | 33/410 X |
| 3,039,196 | 6/1962 | Jernigan | 33/410 X |
| 3,091,865 | 6/1963 | Ernst | 33/410 |
| 3,349,494 | 10/1967 | Blake | 33/410 |
| 4,569,179 | 2/1986 | Post | 52/747.12 X |
| 5,001,839 | 3/1991 | Jones | 33/404 |

FOREIGN PATENT DOCUMENTS

| | | | |
|---|---|---|---|
| 598631 | 10/1959 | Italy | 52/747.12 |

*Primary Examiner*—Carl D. Friedman
*Assistant Examiner*—Winnie S. Yip
*Attorney, Agent, or Firm*—Thomas B. Tate

[57] ABSTRACT

A bracket to hold a bricklayer's speed lead in position on a wall. The bracket, which is contoured to fit the speed lead, has two vertical flanges, one of which is longer than the other, a horizontal flange extending perpendicularly between the vertical flanges, and a stepped block beneath part of the horizontal flange at right angles to the horizontal flange and the longer vertical flange. The bracket is also provided with a rotatably mounted cam and a rotatably mounted bushing.

1 Claim, 3 Drawing Sheets

BRACKET FOR SPEED LEAD

SUMMARY AND BACKGROUND OF THE INVENTION

Bricklayers use speed leads to enable them to lay plumb and level brick corners quickly. The speed lead is held to the brick wall by means of a bracket. With the type of bracket currently used in the industry, the speed lead fits into a slot in the bracket.

The present invention is designed so that the speed lead fits between one of the flanges of the bracket and an adjustable cam. Advantages of the invention are that it can fit on either the inside or outside edge of the speed lead and it is reversible. This type of bracket is especially well-suited for use with a speed lead 10 of the type described in my U.S. Pat. No. 4,569,179, which has a reversible clip 20.

DESCRIPTION OF THE INVENTION

Figure 1:
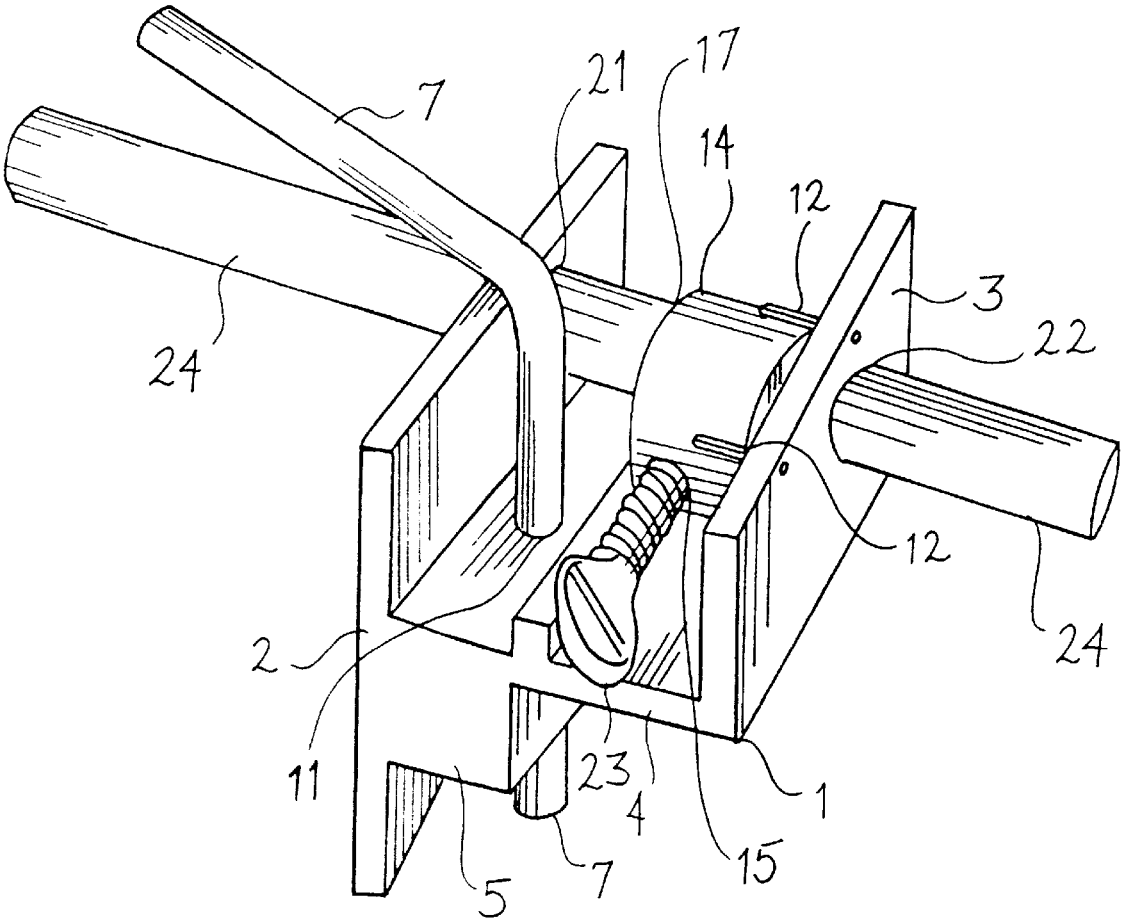
FIG. 1 is a side perspective view of the invention.
Figure 2:
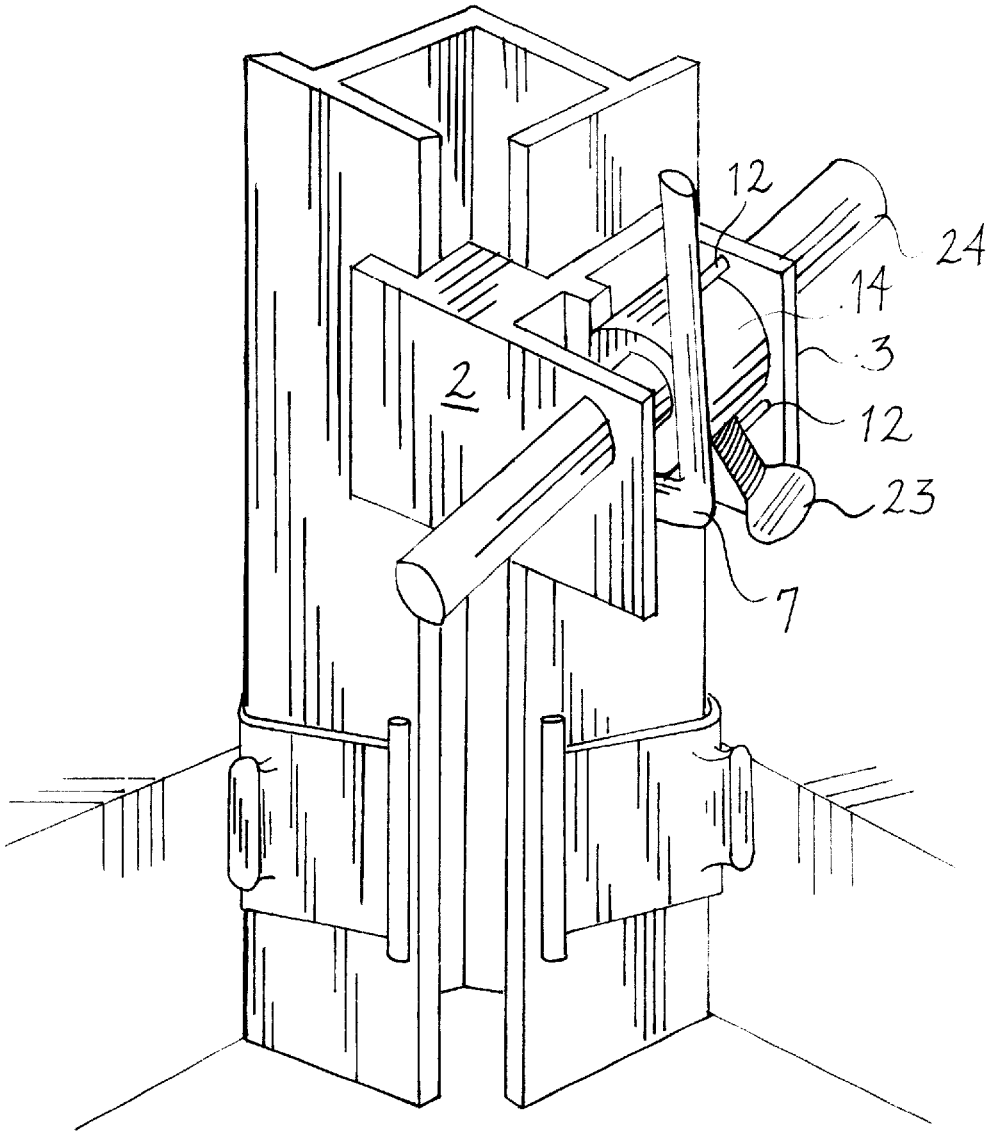
FIG. 2 shows an example of how the bracket may be attached to a speed lead which is being used on a corner of a brick wall.
Figure 3:
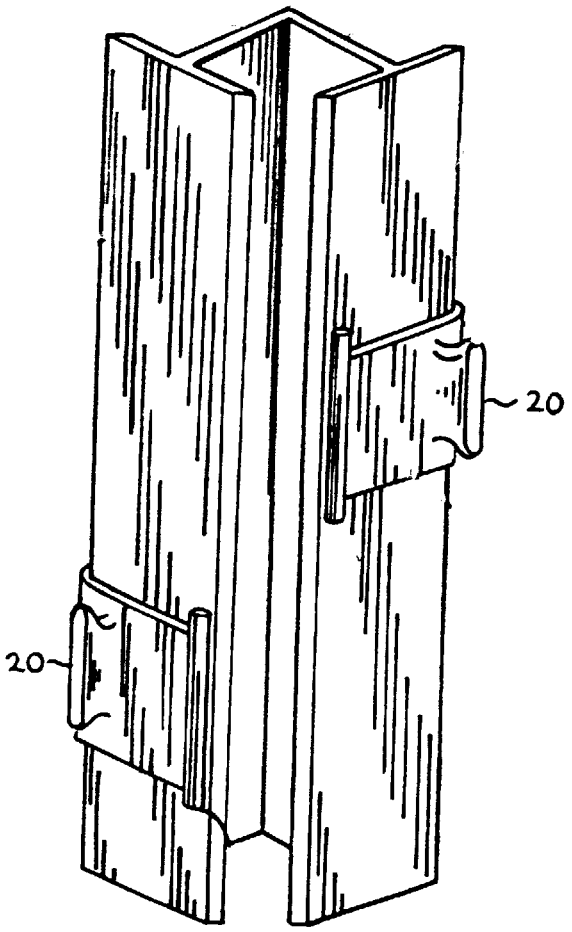
FIG.3. PRIOR ART
FIG. 3 shows a prior art (U.S. Pat. No. 4,569,179) speed lead with reversible clips 20.

The bracket has a base 1 which has a long vertical flange 2, a short vertical flange 3, and a horizontal flange 4 which extends from one end of the short vertical flange 3 to a point approximately midway along the length of the long vertical flange 2, perpendicular to both vertical flanges 2 and 3. A rectangular stepped block 5 is formed adjacent to of the horizontal flange 4 at right angles to the horizontal flange 4 and to the long vertical flange 2.

An adjustable cam 7, which is a cylindrical shaft, is disposed vertically through an opening 11 in horizontal flange 4 and stepped block 5 so that an end of the cam 7 projects beyond the stepped block 5. Depending upon whether the speed lead is to be used on an inside or outside corner of the brick wall (W), either the inside or the outside edge of the speed lead is inserted into the space between the part of the cam 7 which projects beyond the stepped block 5 and the part of the long vertical flange 2 which extends outwardly from the stepped block 5. The speed 10 lead can be inserted either forward or backward. Thus there are four possible positions: speed lead facing forward with its outside edge held by bracket, speed lead facing forward with its inside edge held by bracket, speed lead facing backward with its inside edge held by bracket, or speed lead facing backward with its outside edge held by bracket. The cam 7 is rotated to tighten or loosen the bracket to allow the speed lead to be inserted or released. When the cam 7 is in the middle position in which a horizontal part of cam 7 extends at right angles crossing above the outer parts of either the long vertical flange 2 and the short flange 4, the bracket is loosened to allow the edge of the speed lead to be inserted; rotating the cam 7 in either direction (clockwise or counterclockwise directions) tightens the bracket to engage the edge of the speed lead. The two positions of maximum tightness occur when the cam 7 has been rotated clockwise ninety degrees from the middle position, or alternatively, the cam 7 has been rotated counterclockwise ninety degrees from the middle position.

Two cotter pins or prongs 12 project inward from the short vertical flange 3. An oversize shaft or bushing 14 is held in position between the prongs 12. The bushing 14 has a small opening 15 in its side into which a conventional thumbscrew 23 can be inserted, and a large central opening 17 into which a conventional rod 24 can be inserted, the rod 24 is also passed through openings 21 and 22 in vertical flanges 2 and 3, respectively. The bushing 14 and thumbscrew 23 can be used for in and out adjustment of the bracket on the wall W. The end of the rod 24 engages the wall. By loosening the thumbscrew 23, the bracket can be slid along the rod 24 to a position closer to or farther away from the wall and then held in that position by tightening the thumbscrew 23. The bushing 14 is rotatable through a one hundred eighty degree arc about its axis (the rod 24) so that the thumbscrew 23 may also be used on the opposite side of the bracket from that shown in FIG. 1, if necessary. inserted or released. The middle position of the cam 7 (horizontal part of cam 7 extending at right angles above the top of the long vertical flange 2) is to loosen the bracket; rotating the cam 7 in either direction tightens the bracket.

Two cotter pins or prongs 12 project inward from the short vertical flange 3. An oversize shaft or bushing 14 is held in position between the prongs 12. The bushing 14 has a small opening 15 in its side into which a conventional thumbscrew 23 can be inserted, and a large central opening 17 into which a conventional rod 24 can be inserted (the rod 24 is also passed through openings 21 and 22 in vertical flanges 2 and 3, respectively). The bushing 14 and thumbscrew 23 can be used for in and out adjustment of the bracket on the wall.

I claim:

1. A bracket for holding a bricklayer's speed lead in position on a brick wall, said bracket comprising:

a base adapted to be mounted on a brick wall, said base comprising a long vertical flange, a short vertical flange, a horizontal flange formed perpendicularly to said vertical flanges and extending from one end of said short vertical flange to the approximate midway point of the length of said long vertical flange, a rectangular stepped block formed adjacent said horizontal flange and said long vertical flange at right angles to said horizontal flange and to said long vertical flange;

a cylindrical shaft rotatably mounted through an opening formed in said horizontal flange and said stepped block of said base, said cylindrical shaft and said long vertical flange forming a space therebetween for insertion of the speed lead, said cylindrical shaft having a curved portion being rotatable in opposite directions over the long vertical flange and said short vertical flange respectively for tightening and loosing the bracket from the speed lead;

a pair of prongs projecting inward from said short vertical flange of the base;

a bushing rotatably mounted between the prongs;

and an elongated rod having one end adapted to engage the brick wall and another end crossing though holes formed on said long vertical flange, said bushing, and said short vertical flange respectively, and said bushing being fixed and loosed from said elongated rod for slidably adjusting the position of the bracket along the elongated rod.

* * * * *